US007224377B1

(12) United States Patent
Siwinski

(10) Patent No.: US 7,224,377 B1
(45) Date of Patent: May 29, 2007

(54) THERMAL PRINT HEAD MODULATION USING ADDITIVE COMPLEMENTS

(75) Inventor: Michael J. Siwinski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/358,811

(22) Filed: Jul. 22, 1999

(51) Int. Cl.
*B41J 2/52* (2006.01)
*B41J 2/205* (2006.01)

(52) U.S. Cl. ..... 347/211; 347/183; 358/457

(58) Field of Classification Search ..... 358/455, 358/456, 457, 458, 534; 347/183, 211, 10
See application file for complete search history.

(56) References Cited

U.S. PATENT DOCUMENTS 5,321,427 A * 6/1994 Agar et al. ..... 347/183
5,321,429 A 6/1994 Ono et al.
5,768,411 A * 6/1998 Shu et al. ..... 358/457

* cited by examiner

*Primary Examiner*—Huan Tran

(74) *Attorney, Agent, or Firm*—William F. Noval

(57) ABSTRACT

A thermal print head in a thermal printer for printing a digital image, the digital image being composed of lines of multi-bit pixels, the print head having a plurality of thermal resistors, adapted to be simultaneously addressed in parallel by a corresponding plurality of shift register elements, the print head being pulsed a plurality of times to print one line of the image. The print head is driven by providing a table of additive complement values, one additive complement value for each of the possible values of a multi-bit pixel, successively adding each of the complement values to each of the pixel values in a line to create a succession of sums, each sum having an overflow bit, and applying the overflow bits to the shift register elements to drive the print head.

11 Claims, 6 Drawing Sheets

| Complement | 63 | 62 | 61 | 60 | 59 | 58 | 57 | ... |
|---|---|---|---|---|---|---|---|---|
| Pixel Value | 5 | 5 | 5 | 5 | 5 | 5 | 5 | ... |
| Sum | 68 | 67 | 66 | 65 | 64 | 63 | 62 | ... |
| Sum(7 bit binary) | 1000100 | 1000011 | 1000010 | 1000001 | 1000000 | 0111111 | 0111110 | ... |
| Modulation bit | 1 | 1 | 1 | 1 | 1 | 0 | 0 | ... |

FIG. 4

| Complement | 63 | 58 | 61 | 57 | 62 | 60 | 59 | ... |
|---|---|---|---|---|---|---|---|---|
| Pixel Value | 5 | 5 | 5 | 5 | 5 | 5 | 5 | ... |
| Sum | 68 | 63 | 66 | 62 | 67 | 65 | 64 | ... |
| Sum(7 bit binary) | 1000100 | 0111111 | 1000010 | 0111110 | 1000011 | 1000001 | 1000000 | ... |
| Modulation bit | 1 | 0 | 1 | 0 | 1 | 1 | 1 | ... |

FIG. 5

| | | | | | | | | |
|---|---|---|---|---|---|---|---|---|
| Complement | 63 | 63 | 63 | 60 | 59 | 58 | 57 | ... |
| Pixel Value | 5 | 5 | 5 | 5 | 5 | 5 | 5 | ... |
| Sum | 68 | 68 | 68 | 65 | 64 | 63 | 62 | ... |
| Sum(7 bit binary) | 1000100 | 1000100 | 1000100 | 1000001 | 1000000 | 0111111 | 0111110 | ... |
| Modulation bit | 1 | 1 | 1 | 1 | 1 | 0 | 0 | ... |

FIG. 6

THERMAL PRINT HEAD MODULATION USING ADDITIVE COMPLEMENTS

FIELD OF THE INVENTION

The present invention relates to thermal printers, and more particularly to a method and apparatus for driving a thermal print head in a thermal printer.

BACKGROUND OF THE INVENTION

In a thermal printer for displaying a digital image, a thermal print head having a plurality of heaters is activated to transfer dye from a dye carrier medium to an image receiver such as paper. To achieve a continuous tone, the heaters in the thermal print head are modulated to transfer desired amounts of dye for each pixel in the image. The digital image is typically stored as a number of lines of multi-bit pixels, where the value of each pixel represents the gradation value of the pixel. The task of modulating the print head involves converting the lines of multi-bit pixel values into a number of lines of single bit serial data which are sent to a shift register in the print head as shown in FIG. 3.

A typical serial print head as illustrated in FIG. 3 has a number of heating resistors 50 arranged in a linear array. The head also has a solid state serial input shift register 52. The print head shown (as an example) has 512 resistors, and a single serial shift register that has 512 elements. Each shift register element acts as a digital switch, a 0 bit in the element will not close the switch, a 1 bit will. When the digital switch is closed, current flows from the DC head voltage supply to the DC head ground when a printing pulse is applied. A resistor that is energized will heat up, and cause thermal dye to be deposited on the print.

To energize the print head, a stream of 512 modulation bits must be clocked into the shift register 52. One bit must be put into each shift register element regardless whether that resistor will be turned on or not. Every time the print head is to be energized, a stream of 512 modulation bits must be clocked into the shift register.

Known modulation methods include "Modulation by Comparison" and "Decrement Until Zero", which will be described below.

Modulation by Comparison

One known method of producing serial modulation bits involves repeatedly comparing a pixel to an incrementally changing threshold value. This method has for example been discussed in U.S. Pat. No. 5,321,427 issued Jun. 14, 1994 to Agar et al. The result of that comparison is used to produce an "on" or "off" modulation bit, normally represented by a one or a zero, respectively. In the example shown in Table I below, a 3-bit pixel with a gradation value of 5 is successively compared to the threshold values of 1 through 7, to produce 7 modulation bits (note that a 3-bit pixel can have any one of $2^3=8$ values between 0 and 7). If the pixel value is greater than or equal to the threshold, then the modulation bit is a "1", otherwise the modulation bit is a "0". The multi-bit pixel value of 5 produces five "1" bits and two "0" bits in this example.

TABLE I

| Modulation By Comparison | | | | | | | |
|---|---|---|---|---|---|---|---|
| Pixel Value | 5 | 5 | 5 | 5 | 5 | 5 | 5 |
| Threshold Value | 1 | 2 | 3 | 4 | 5 | 6 | 7 |
| Modulation Bit | 1 | 1 | 1 | 1 | 1 | 0 | 0 |

Decrement Until Zero

Another method of producing a stream of serial modulation bits from multi-bit pixel values is to successively test each pixel value in a line to determine if it is non-zero. If a pixel's value is non-zero, its value is decremented by one and a "1" modulation bit is produced. The process is then repeated with the decremented pixel values. When a decremented pixel value reaches zero, it is no longer decremented, and the modulation bit produced is a "0". As shown in Table II below, a pixel value of 5 is first determined to be non-zero, it is then decremented to 4, and a "1" modulation bit is produced. This is repeated 4 more times, until the pixel value has been decremented to 0. For the last 2 bits in the example, the pixel value is already 0, so "0" modulation bits are produced, and the pixel value is no longer decremented. The multi-bit pixel value of 5 produces five "1" bits, and two "0" bits.

TABLE II

| Modulation by Decrement Until Zero | | | | | | | |
|---|---|---|---|---|---|---|---|
| Pixel Value (5) | 5 | 4 | 3 | 2 | 1 | 0 | 0 |
| Modulation Bit | 1 | 1 | 1 | 1 | 1 | 0 | 0 |

Low cost digital signal processors (DSP's) are widely available for controlling consumer equipment. DSP's are easily custom programmable to perform operations such as print head modulation. Unfortunately, the Decrement until Zero and Comparison modulation methods both involve conditional operations which are very inefficient when implemented in software, thereby hindering their use with DSP's. A compare operation must always be followed by a conditional operation based on the result of the comparison. A conditional operation typically requires multiple processor cycles to execute, which is inefficient and wastes processor cycles.

There is a need therefore for an improved modulation method for thermal printers that can be more efficiently implemented in software for use in a programmable DSP.

SUMMARY OF THE INVENTION

The above noted needs are met according to the present invention by a thermal print head in a thermal printer for printing a digital image, the digital image being composed of lines of multi-bit pixels, the print head having a plurality of thermal resistors, adapted to be simultaneously addressed in parallel by a corresponding plurality of shift register elements, the print head being pulsed a plurality of times to print one line of the image. The print head is driven by providing a table of additive complement values, one additive complement value for each of the possible values of a multi-bit pixel; successively adding a complement value to each of the pixel values in a line to obtain a number of sums corresponding to the number of pixels in the line, each sum having an overflow bit that is either "0" or "1", depending on the respective pixel value; loading the overflow bits to the shift register elements and applying a printing pulse to the print head; and repeating the adding and loading steps for each complement value in the table.

There is a significant advantage achieved from using the present invention with an inexpensive programmable processor, as opposed to using a relatively more expensive custom integrated circuit. The advantage results from the fact that by avoiding the use of a compare operation to determine if a modulation bit should be a "1" or a "0". The more computationally efficient algorithm of the present invention allows the use of a low cost DSP to perform the modulation task, thereby reducing the cost of the thermal printer.

The efficiency of the modulating process can be further improved by accumulating a number of overflow bits in a multibit data word before sending them out to the print head as a group of modulation bits, thereby avoiding a plurality of multicycle instructions in the DSP program, compared to separately sending each single modulation bit to the print head.

Since the value and time placement of each modulation bit is controlled by the value and placement of the additive complement values in the complement table, this method also has the advantage of providing for a high level of control over the characteristics of the produced serial bit stream.

BRIEF DESCRIPTION OF THE DRAWINGS

FIG. 4 is a table illustrating the method of generating modulation bits by addition of additive complements according to the present invention;

FIG. 5 is a table showing a rearranged order of additive complements to distribute the modulation bits according to a preferred embodiment of the present invention;

FIG. 6 is a table showing the use of repeated additive complement values to obtain a non-linear response to the pixel values according to an alternative mode of practicing the present invention;

DETAILED DESCRIPTION OF THE INVENTION

Figure 1:
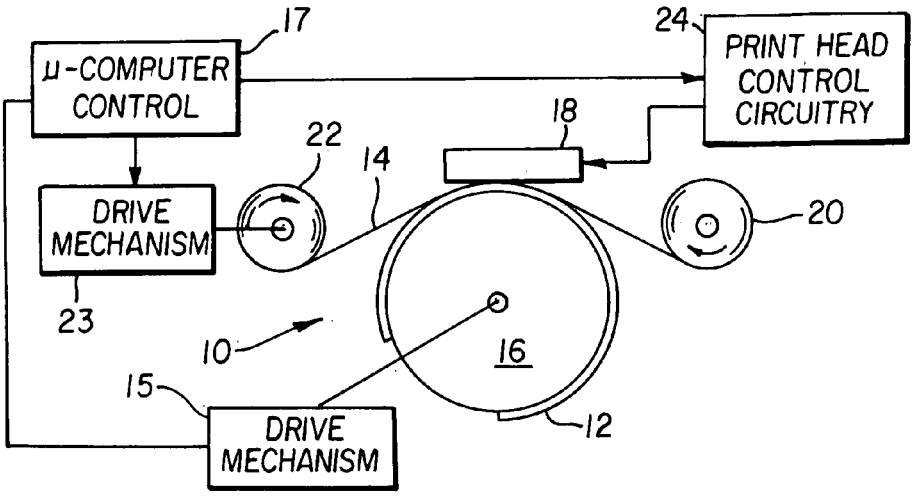
FIG. 1 is a schematic diagram of a prior art thermal printing apparatus of the type which can be employed in accordance with the present invention.

Referring to FIG. 1, there is shown in schematic form a thermal printing apparatus 10 which is adapted to print color images on a receiver member 12 from dyes transferred from a carrier member 14. The receiver member 12, in the form of a sheet is secured to a rotatable drum 16 which is mechanically coupled to a drive mechanism 15. It will be understood that the drive mechanism 15 includes a motor adapted to advance the drum 16 and receiver sheet 12, under a thermal print head 18. The print head 18 has a plurality of thermal heaters which press the carrier member 14 against the receiver sheet. The carrier member 14 is shown in the form of a web and is driven from a supply roller 20 onto a take-up roller 22 by a drive mechanism 23 coupled to the take up roller 22. The drive mechanisms 15 and 23 each include motors which continuously advance the carrier and receiver relative to the thermal heaters of the print head 18.

In operation, drive signals are continuously provided to the drive mechanism 15 from a microcomputer control circuit 17 to rotate the drum 16 to bring successive, contiguous areas of the receiver sheet 12 into the print region opposite print head 18. A portion of a dye frame is disposed between the print head 18 and the receiver sheet 12. As noted above, these members are moved relative to the print head during the print operation. Printing pulses are supplied to the thermal resistors of the print head 18 by print head control circuitry 24, thereby heating the thermal resistors and causing dye to transfer from the carrier member 14 to the receiver 12. In a preferred embodiment of the invention, the print head control circuitry 24 comprises a DSP, such as the TMS 320 LC 549 DSP available from Texas Instruments. DSP's of this type are widely available and relatively inexpensive.

The present invention performs the modulation task by producing a pulse count modulated stream of bits from a multi-bit pixel gradation value. According to the invention, the modulation bits are produced by repeatedly adding a series of constants to the pixel value, and using the overflows that are produced, as the modulation bits.

In a typical printing system, the number of modulation levels that can be produced by the print head is usually chosen to be an integral power of 2 (i.e. 64, 128, 256, etc.) The following description will discuss an implementation of the method of the present invention using 64 modulation levels, or 6-bit pixel values. It will be understood that the invention is equally applicable to systems employing pixels having more or fewer bits.

Figure 2:
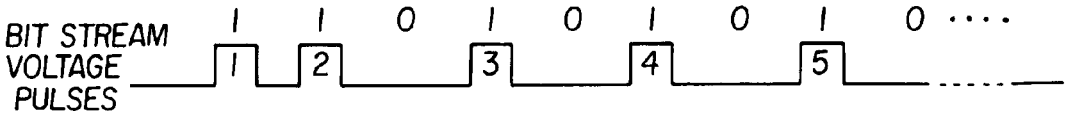
FIG. 2 is a diagram showing a bit stream and a series of heating pulses useful in describing the invention.

In a 6-bit printing system, each pixel can have a gradation value of 0 through 63. An output bit stream for driving a thermal resistor in the print head will have 63 bits representing 63 time periods where voltage pulses can be applied to the print head. A pixel value of zero will have all of the 63 bits set to zero, and no voltage pulses will be sent to the thermal resistor in the print head for printing that pixel. A pixel value of one will have one bit set to one, and 62 bits set to zero, so that only one voltage pulse will be sent to the print head for that pixel. A pixel value of 2 will contain two bits that are set to one, etc. FIG. 2 shows an example of a bit stream that might be produced for a pixel value of 5. Note that all of the "1's", representing high pulses can, but don't necessarily have to be consecutive within the bit stream.

Figure 3:
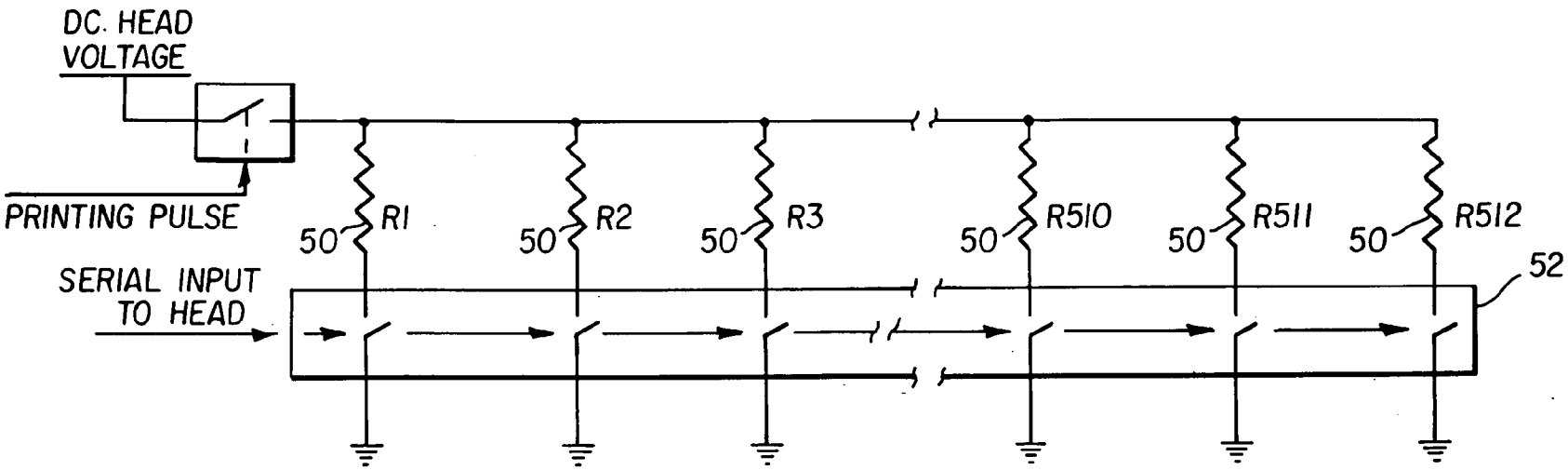
FIG. 3 is a simplified diagram of a prior art thermal print head of the type in which the present invention can be employed.

According to the present invention, a table is prepared that contains 63 different additive complement values. An additive complement is a number that is added to a pixel value, to test the magnitude of that value. The result of the addition will indicate if the pixel value being tested is less than a predetermined threshold, or if it is greater-than or equal-to the predetermined threshold. The result of the addition is irrelevant, but any overflow out of the sum produced in the form of a 0 bit or a 1 bit, is the modulation bit that is sent to the print head to control the temperature of the corresponding heating resistor as shown in FIG. 3.

According to the method, these additive complements are successively added to the pixel value being modulated. Depending on the value of the additive complement, and the pixel value being modulated, the sum that is produced will produce an overflow (a carry bit), or it won't. The overflow will always be a single bit, and if an overflow occurs, it will always place the single overflow bit into the next higher bit position above the most significant bit of the larger of the two numbers. This overflow bit is used as the modulation bit. Since this bit is produced by a simple binary addition operation, and does not require any comparison or conditional operation, it is efficiently programmable in software, suitable for implementation in a DSP.

Table III in FIG. 4 shows how this method would be used to generate a string of 7 modulation bits when the pixel value is 5. The table only shows the first 7 bits in a string of 63 bits, it being understood that the remainder of the additions will produce "0" modulation bits. The first row across, labeled "Complement", contains the constants that are added to the pixel value of 5 to generated overflow bits. The values are shown for ease of understanding as decimal numbers, but it is to be understood that the values used in the program will be binary numbers. The first five sums in the table produce an overflow (a "1" modulation bit), and the last two sums do not produce an overflow (a "0" modulation bit). The multi-bit value of 5 in a 6-bit pixel produces five "1" bits and 58 "0" bits. Similarly, a multi-bit value of 3 would produce three "1" bits, and 60 "0" bits, etc.

Often it is desirable to distribute the voltage pulses to the print head so that they are not all grouped together. Table IV in FIG. 5 shows the same scenario as in Table III, with the exception that the value in the complement row have been arbitrarily rearranged. The result is that there are still five "1" bits, and 58 "0" bits in the modulation bit stream, but the "1's" have been scattered throughout the bit stream. The exact distribution pattern of bits can be controlled by adjusting the arrangement of the complement values in the complement table.

A simple "linear" complement table would contain 63 different complement values, sequentially numbered from 63 down to 1. Using these values, a pixel value of 0 will not produce an overflow when added to any of these values, so every modulation bit produced will be a "0" bit. A pixel value of 63 will produce an overflow when added to any of the complement values, so every modulation bit will be a "1".

If a value of 0 is inserted into the complement table, the resulting sum will always fit within 6 bits, and the overflow bit will always be zero. This has the effect of imposing a maximum on the duty cycle that can be achieved. For example, if roughly half of the values in the complement table were 0, the resulting bit stream could never have a duty cycle of over 50%. This provides a fast and efficient way to adjust the density of a printed line on the fly, e.g. as a result of image processing steps that might require that the current line to be printed lighter.

Table V in FIG. 6 shows the same scenario as in FIG. 4, with the exception that the first complement value of 63 has been repeated twice. In a table containing 63 complements, repeating certain entries would require that other entries won't exist in the table. This has the effect of producing a non-linear response to the value of the pixel being modulated. The repeated complements will produce extra modulation bits for any pixel value that would have generated a modulation bit for that complement value.

This provides a fast and efficient way to adjust the density of a printed line on the fly, e.g. as a result of image processing steps that might require that the current line to be printed darker. This method can also be used for compensating non-linear characteristics of the printing apparatus.

Figure 7:
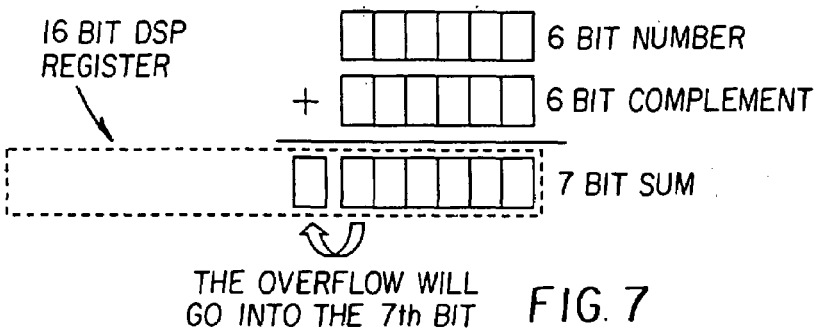
FIG. 7 is a diagram showing the position of an overflow bit after adding of a 6 bit pixel value and a 6 bit complement.

According to the invention the complement value in the complement table can have the same bit size as the pixel value, as shown in FIG. 7, so that after adding of the two values the overflow bit occurs in the next higher bit position. Since the adding operation is carried out in the DSP, the resulting sum appears in a data register where the sum is been disregarded and only the overflow bit is to be sent to the print head as the modulation bit.

Figure 8:
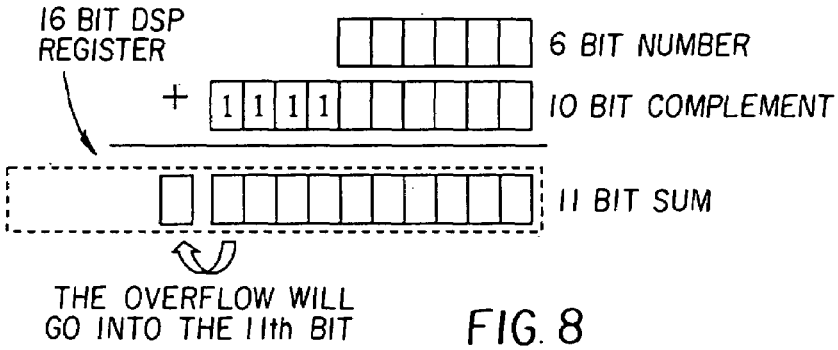
FIG. 8 is a diagram showing the placement of an overflow bit by adding of a 6 bit pixel value and a 10 bit complement.

In some cases, it might be desirable that the overflow bit is generated at a preferred bit position within the data word to improve the efficiency of the DSP program. This can be accomplished by making the bit size of the complement value larger than the bit size of the pixel value. In FIG. 8 a 6 bit pixel value is shown that is added to a 10 bit complement. The overflow will then appear in the next higher bit position in the DSP register, in this example at the $11^{th}$ bit. The 6 bit complement of FIG. 7 can easily be extended to a length of 10 bit by putting 4 "1" bits to the higher bit positions. If then an overflow occurs in the lower 6 bits as in FIG. 7, this overflow will be carried on to the $11^{th}$ bit. In this way, by extending the complement by the right number of "1" bits, the overflow, or modulation bit can be placed at any position to the left of the original 6 bit number within the DSP register.

The overflow bit has then to be read out from the DSP register and sent to the print head. A read instruction however, is a multicycle instruction which is very inefficient in a DSP program, as mentioned before. It would therefore be desirable to successively process a plurality of pixel values and to place the resulting plurality of overflow bits adjacent to each other into the DSP register. This can be done by altering the bit length of the complement values in the complement table. The overflow bits can then commonly be read out and sent to the print head as a group of modulation bits, instead of separately reading out each single overflow bit. This saves many multicycle instructions, depending on how many modulation bits will be grouped together, and thereby further increasing processing speed.

Figure 9:
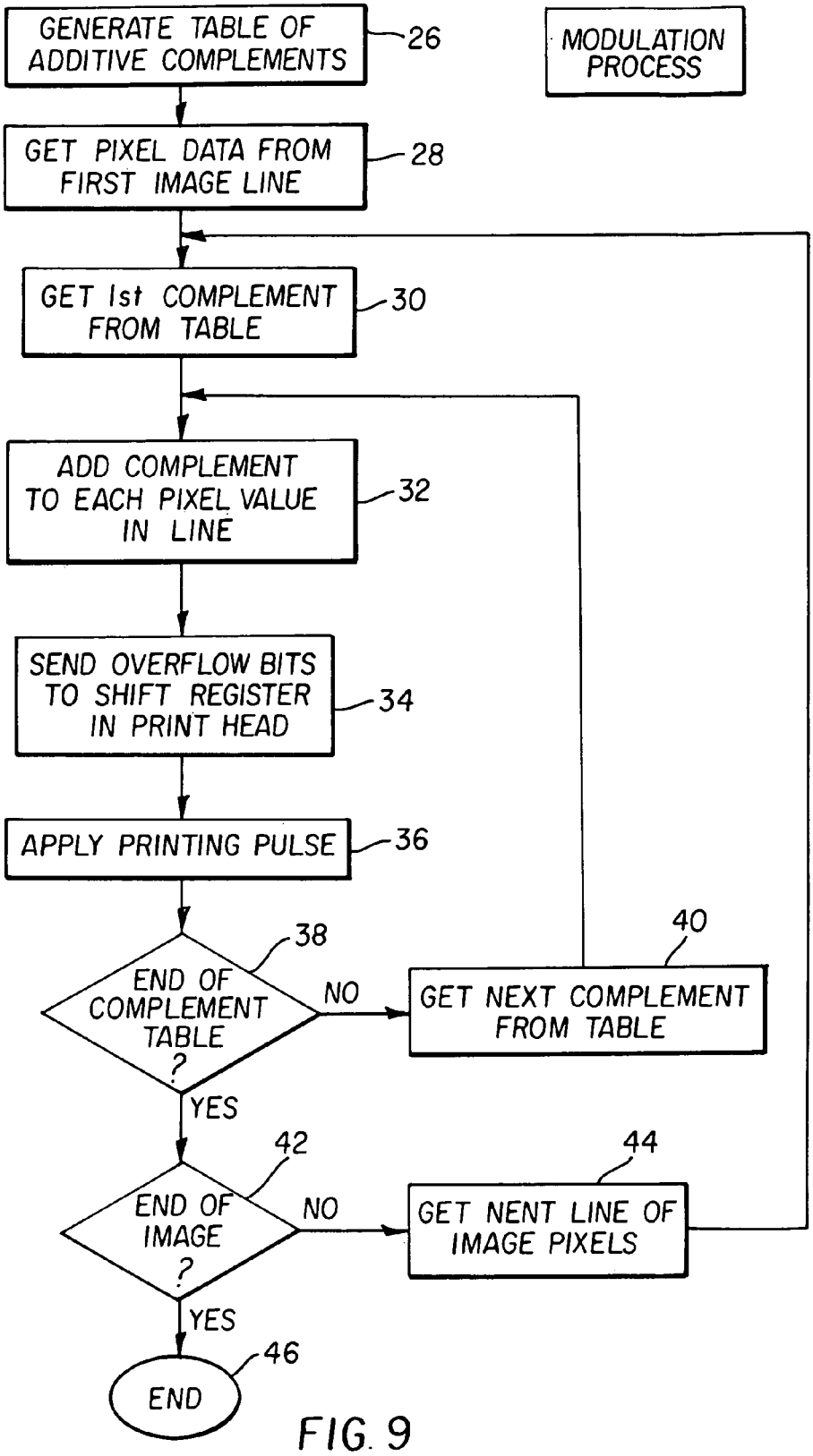
FIG. 9 is a flow chart illustrating the steps of the method according to the present invention.

Referring to FIG. 9, the method of the present invention will now be described. First, in step 26, a table of additive complements is generated and stored in the memory of the DSP. As noted above, in a preferred embodiment of the invention, the complements are arranged such that the "1" bits will be distributed throughout the pixel printing period. Next, in step 28, the first line of pixel data of the image is retrieved from the image memory. The first complement is retrieved in step 30 from the table and added in step 32 to each pixel value in the first line of pixels to generate a line of overflow bits. The overflow bits are then sent to the shift register in print head 18 in step 34 and a printing pulse is applied in step 36. In step 38, a check is then made to determine if the end of the table of complements has been reached. If not, in step 40 the next complement is retrieved from the table, and steps 32-38 are repeated.

If the end of the table of complements has been reached, a check is made in step 42 to determine if the end of the image has been reached. If not, the next line of image pixels is retrieved, and steps 30-42 are repeated. If the end of the image has been reached, the process is ended in step 46.

Figure 10:
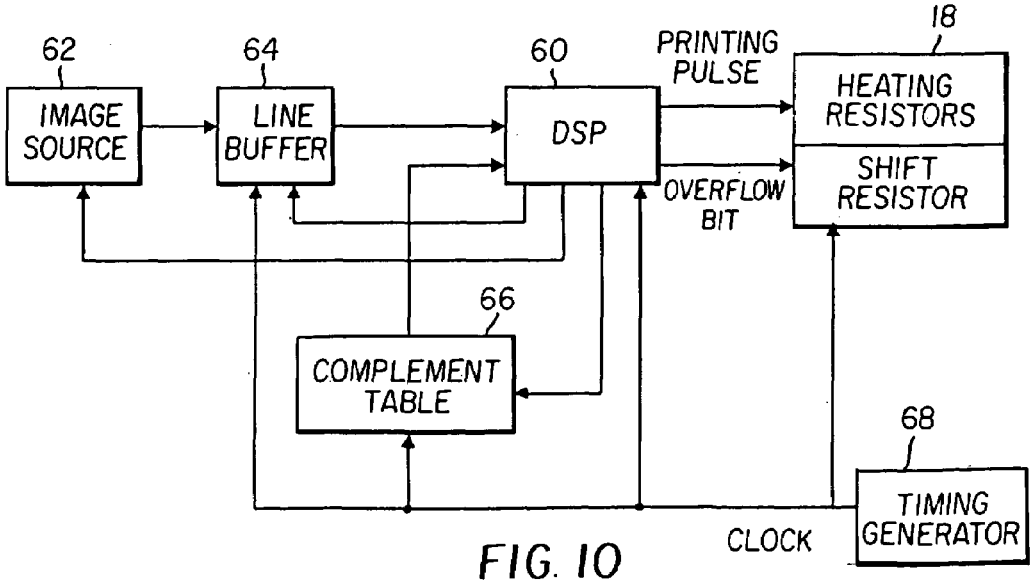
FIG. 10 is a block diagram of an apparatus according to one embodiment of the invention.

In FIG. 10 one embodiment of the invention is illustrated in a block diagram. A digital image that comes from an electronic image source 62, e.g. an image digitizer, an optical disk storage device, a medical imaging modality, or the like is read line by line into a line buffer 64 under control of the DSP 60. The DSP 60 reads the 6 bit pixel data of the image line stored in line buffer 64 and retrieves a complement value from the complement table 66. The two binary values are added in the DSP and the resulting overflow bit is sent to the shift register 52 in the print head 18. This is repeated with all pixels in the image line until the shift register is completely loaded with modulation bits. A printing pulse is then applied to the print head to energize the addressed heating resistors 50. A complete image line is printed when these steps have been repeated until the end of the complement table is reached. The next image line is then read by the DSP.

The invention has been described in detail with particular reference to certain preferred embodiments thereof, but it will be understood that variations and modifications can be effected by those skilled in the art without departing from the spirit and scope of the invention.

PARTS LIST

10 thermal printing apparatus
12 receiver member
14 carrier member
15 drive mechanism
16 rotatable drum
17 control circuit
18 print head
20 supply roller
22 take-up roller
23 drive mechanism
24 print head control circuit
26 generate table of additive complements step
28 get pixel data from first image line step
30 get first complement from table step
32 add complement to each pixel value in line step
34 send overflow bits to print head step
36 apply printing pulse step
38 check for end of table step
40 get next complement from table step
42 check for end of image step
44 get next line of image pixels step
46 end of image print step
50 heating resistors
52 serial shift register
60 Digital Signal Processor (DSP)
62 image source
64 line buffer
66 complement table
68 timing generator

What is claimed is:

1. A method of controlling a thermal print head to print a digital image, the digital image being composed of lines of multi-bit pixels, the print head having a plurality of thermal resistors, adapted to be simultaneously addressed in parallel by a corresponding plurality of shift register elements, the print head being pulsed a plurality of times to print one line of the image, comprising the steps of:

a) providing a table of additive complement values, one additive complement value for each of the possible values of a multi-bit pixel;

b) successively adding a complement value to each of the pixel values in a line to obtain a number of sums corresponding to the number of pixels in the line, each sum having an overflow bit that is either "0" or "1", depending on the respective pixel value;

c) loading the overflow bits of each sum in the line to the shift register elements and applying a printing pulse to the print head;

d) repeating steps b) and c) for each complement value in the table; and e) repeating steps b) to d) for each line of multi-bit pixels in the image.

2. The method as claimed in claim 1, wherein the additive complements in the table have the same bit size as the pixel values such that after the adding step, the overflow bit is generated in the next higher bit position.

3. The method as claimed in claim 1, wherein the additive complements in the table have a bit size greater than the bit size of the pixel values, the bits exceeding the pixel bit size all being "1" bits, such that after the adding step, the overflow bit will be positioned at the next higher bit position of the larger of the two values.

4. The method as claimed in claim 3, wherein the bit size of the additive complements is selected such that the overflow bit is placed at a predetermined position within a 16 bit data word.

5. The method as claimed in claim 4, wherein a plurality of successive overflow bits are generated adjacent to each other within said 16 bit data word and commonly sent out to the print head as a group of modulation bits.

6. The method as claimed in claim 1, wherein the additive complements in the table are arranged in an order such that the modulation bits are arbitrarily distributed within the pixel print period.

7. The method as claimed in claim 1, wherein the table of additive complements repeats one or more of the complement values a number of times, and omits others, thereby providing a non-linear gradation characteristic of the printing system.

8. A thermal printer for printing a digital image composed of lines of multi-bit pixels, comprising:

a) a print head having a plurality of thermal resistors, adapted to be simultaneously addressed in parallel by a corresponding plurality of shift register elements, the print head being pulsed a plurality of times to print one line of the image;

b) means for storing a table of additive complement values, one additive complement value for each of the possible values of a multi-bit pixel;

c) means for successively adding the complement values to each of the pixel values in a line to obtain for each complement value a number of sums corresponding to the number of pixels in the line, each sum having an overflow bit that is either "0" or "1", depending on the respective pixel value;

d) means for loading the overflow bits of each sum in the line to the shift register elements; and e) means for applying a printing pulse to the print head.

9. The thermal printer claimed in claim 8, further comprising means for successively generating a plurality of overflow bits and for placing the overflow bits adjacent to each other within a 16 bit data word before sending them out to the print head as a group of modulation bits.

10. The thermal printer claimed in claim 8, wherein the additive complements in the table are arranged in an order such that the modulation bits are arbitrarily distributed within the pixel print period.

11. The thermal printer claimed in claim 8, wherein the table of additive complements repeats one or more of the complement values a number of times, and omits others, thereby providing a non-linear gradation characteristic of the printing system.

* * * * *